US009540213B2

(12) United States Patent
Holverson

(10) Patent No.: US 9,540,213 B2
(45) Date of Patent: Jan. 10, 2017

(54) CONTROL SYSTEM FOR POWERED ROTATION

(71) Applicant: Monroe Truck Equipment Inc., Monroe, WI (US)

(72) Inventor: Andrew Holverson, Mineral Point, WI (US)

(73) Assignee: MONROE TRUCK EQUIPMENT, INC., Monroe, WI (US)

( * ) Notice: Subject to any disclaimer, the term of this patent is extended or adjusted under 35 U.S.C. 154(b) by 134 days.

(21) Appl. No.: 14/221,376

(22) Filed: Mar. 21, 2014

(65) Prior Publication Data

US 2015/0266698 A1 Sep. 24, 2015

(51) Int. Cl.
*B65H 75/30* (2006.01)
*B65H 75/44* (2006.01)

(52) U.S. Cl.
CPC ..... *B65H 75/4486* (2013.01); *B65H 75/4481* (2013.01)

(58) Field of Classification Search
CPC ..... B65H 75/30
USPC ..... 242/391.3, 356.7, 352.4, 541.3; 474/113, 474/114, 106, 107
See application file for complete search history.

(56) References Cited

U.S. PATENT DOCUMENTS

| | | | | | |
|---|---|---|---|---|---|
| 2,880,943 | A * | 4/1959 | Stephens | 242/533.1 | |
| 4,513,772 | A * | 4/1985 | Fisher | B65H 75/4407 | 137/355.22 |
| 4,826,469 | A * | 5/1989 | Cooley | F16H 7/14 | 411/161 |
| 5,215,278 | A * | 6/1993 | Hess | 242/557 | |
| 6,032,717 | A * | 3/2000 | Belgoff | 160/309 | |
| 6,299,094 | B1 * | 10/2001 | James, Jr. | 242/390 | |
| 6,672,329 | B1 * | 1/2004 | Brooks | B65H 75/38 | 137/355.2 |
| 2011/0306450 | A1 * | 12/2011 | Chou | F16H 7/14 | 474/114 |

* cited by examiner

*Primary Examiner* — Sang Kim
(74) *Attorney, Agent, or Firm* — Quarles & Brady LLP

(57) ABSTRACT

A system is described for controlling the engagement of a rotating drive, such as a drive for a hose reel. A power source provides rotational power to a first rotating member. A power-transfer device extends between the first rotating member and an input portion of a second rotating member. A control member linked to the first rotating member moves between first and second orientations to move the first rotating member between engaged and disengaged positions. In the engaged position, the power-transfer device is engaged to allow transfer of rotational power from the power source to the second rotating member. In the disengaged position, the power-transfer device is disengaged such that rotational power is not transferred from the power source to the second rotating member.

18 Claims, 8 Drawing Sheets

CONTROL SYSTEM FOR POWERED ROTATION

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to the control of powered rotating machinery, including powered reels for winding and unwinding a hose or other apparatus.

BACKGROUND OF THE DISCLOSURE

In various applications, powered rotation may facilitate various useful operations. For example, powered reel assemblies may be utilized to wind various material or devices, such as hoses, cords, ropes or chains, around a rotatable reel core for relatively compact storage and relatively easy transport. As desired, the material or devices may then be unwound for use, rewound again for continued storage or transport, and so on. In certain instances, such winding (or unwinding) may be facilitated by various power sources. For example, electrical or hydraulic motors may provide rotational power to a reel assembly in order to allow for powered winding (or unwinding) of a rope, hose, cord, or chain, and so on.

SUMMARY OF THE DISCLOSURE

A control assembly is disclosed for controlling operation of a powered rotation, including powered rotation of a reel core.

According to one aspect of the disclosure, a power source, such as an electrical motor, provides rotational power to a first rotating member, such as a powered wheel. A power-transfer device, such as a belt, extends between the first rotating member and an input portion of a second rotating member, such as an input wheel of a hose-reel core. A control member linked to the first rotating member moves between first and second orientations to move the first rotating member between engaged and disengaged positions. In the engaged position, the power-transfer device is engaged to allow transfer of rotational power from the power source to the second rotating member. In the disengaged position, the power-transfer device is disengaged such that rotational power is not transferred from the power source to the second rotating member.

In certain embodiments, one or more of the following features may be included. At the engaged position, the first rotating member may place the power-transfer device under a first tension to allow transfer of power between the first rotating member and the second rotating member. At the disengaged position, the first rotating member may release the power-transfer device from the first tension, to prevent transfer of power between the first rotating member and the second rotating member. Guide members may restrict movement of the power-transfer device when the first rotating member is in the disengaged position. The first rotating element may be biased toward the disengaged position.

One or more of the power source and the first rotating member may be slidably mounted to a frame, whereby sliding the power source or the first rotating member along the frame may cause the first rotating member to move between the engaged and disengaged positions. The frame may include an opening between first and second sides of the frame, with the power source located, at least in part, on the first side of the frame and the first rotating member located, at least in part, on the second side of the frame. A slide plate may be located, at least in part, on the second side of the frame and between the power source and the first rotating member, such that moving the control member between the first and second orientations causes the slide plate, and the first rotating member, to move along the opening.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like members. Certain features have been omitted from certain figures for clarity of presentation.

DETAILED DESCRIPTION

The following describes one or more example embodiments of the disclosed control system, as shown in the accompanying figures of the drawings described briefly above. Various modifications to the example embodiments may be contemplated by one of skill in the art.

As noted above, powered rotating machinery may be employed in various useful applications. For example, powered reels may be mounted to vehicles or other platforms, for automated (or semi-automated) winding or unwinding of devices or materials such as ropes, hoses, cords, chains, and so on. In certain embodiments, it may be useful to selectively control the rotation of such devices. For example, it may be useful to provide a control system to selectively control delivery of power to a rotating component, such as a reel core of a powered reel.

In certain embodiments, a flexible power-transfer device (e.g., a belt or chain) may extend between a driven member (e.g., an input wheel of a reel core) and a powered member (e.g., a separate, powered wheel). In such a configuration, a power source may rotate the powered member, which may transmit power via the power-transfer device to the driven member, and thereby cause the driven member to rotate (e.g., in order to wind a hose on a reel). In order to control this flow of power, the powered member may be mounted to a frame such that it may be moved along the frame, with respect to the driven member, by way of a control mechanism (e.g., a lever, rod, or other member or assembly). In this way, the powered member may be moved along the frame between an engaged position, in which the power-transfer device is engaged for transfer of power from the power source to the driven member via the power-transfer device, and a disengaged position, in which the power-transfer device is disengaged and, as such, does not transfer power to the driven member via the power-transfer device.

In an embodiment for a powered reel assembly, for example, a flexible belt may extend between an input sheave attached to a reel core and a powered sheave driven by a motor. The powered sheave may be movably (e.g., slidably) mounted to a frame of the reel assembly, such that it may be moved between an engaged position (or positions) and a disengaged position (or positions) by a control lever (or other control device). At an engaged position, the powered sheave may place the flexible belt under operational tension and thereby allow transmission of power from the motor to the input sheave (and the reel core) via the powered sheave and the belt. At a disengaged position, the powered sheave may release tension from the belt, thereby preventing transmission of power from the electrical motor to the input sheave (and the reel core) via the powered sheave and the belt. Various other embodiments may also be possible, with various additional (or alternative) configurations and features, as will be apparent from the disclosure herein.

Figure 1:
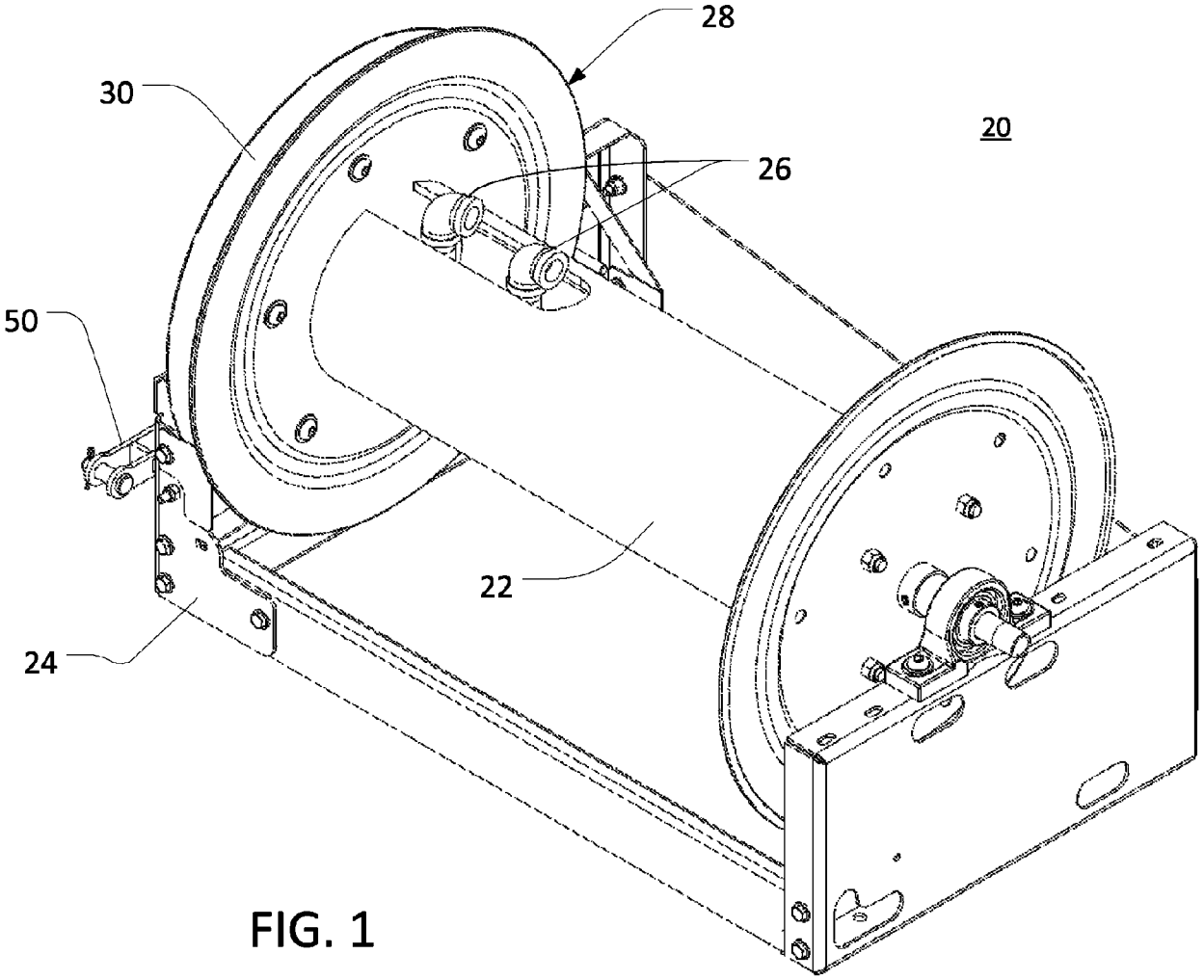
FIGS. 1-3 are perspective views of an example reel assembly and example control system.

Referring now to FIG. 1, an embodiment of the disclosed control system may be implemented with respect to powered rotating machinery, such as reel assembly 20. As depicted in the various figures, reel assembly 20 includes reel core 22 (e.g., a rotatable cylinder or drum) rotatably mounted to reel frame 24 (which may be formed from one or more distinct components). Reel core 22 receives rotational power via input wheel 28, which is depicted in the various figures as a sheave or pulley. As depicted, wheel 28 is configured to receive a v-belt, such as belt 38 (hidden by belt guard 30 in FIG. 1). It will be understood, however, that various other configurations are possible, including those with flat or curved pulleys, notched wheels, toothed sprockets or gears, and so on, as paired with appropriately complimentary belts, ropes, chains, and so on.

Reel assembly 20 is depicted as a hose reel assembly, with features such as hose connections 26 for providing pressurized fluid through assembly 20 to various attached hoses (not shown). For example, each of connections 26 may be configured to provide a different chemical or fluid to a distinct hose for various dual-spray applications. It will be understood, however, that aspects of the disclosed control system may also be implemented with respect to various other reel types, as well as other types of rotating machinery.

Figure 2:
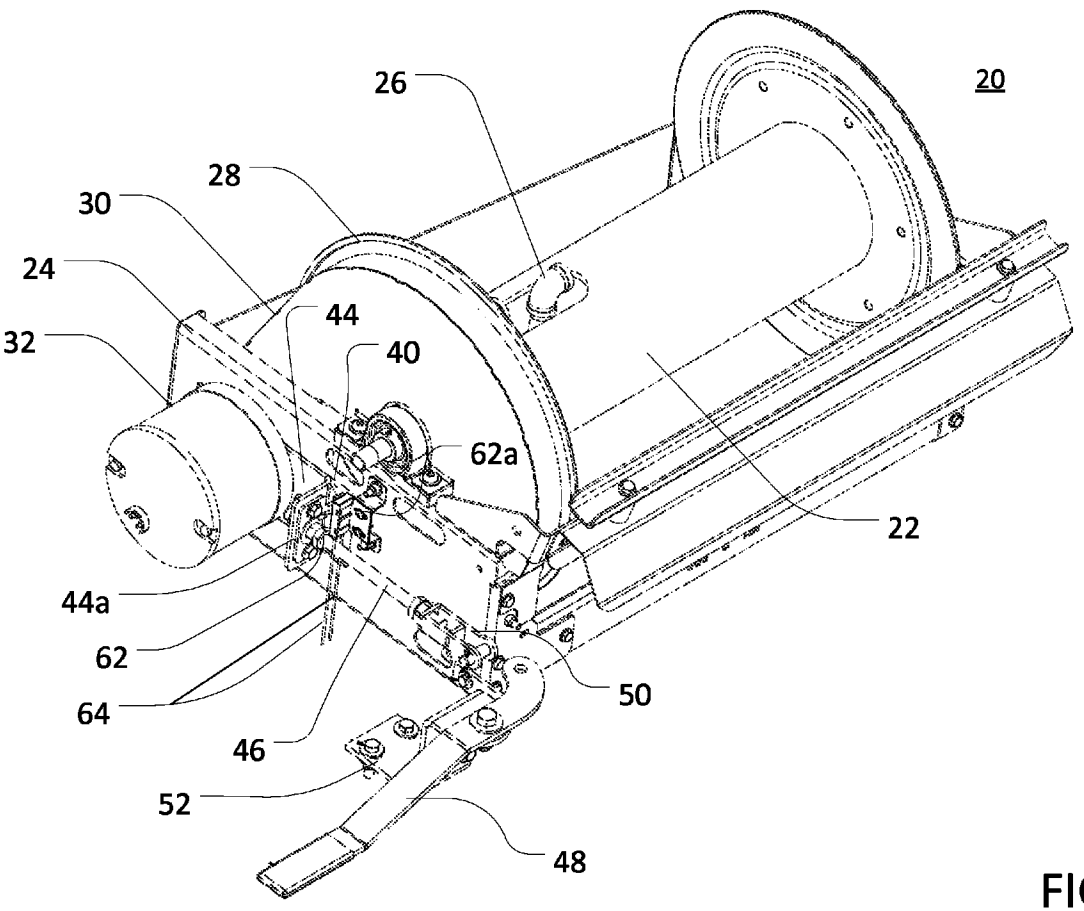
Figure 3:
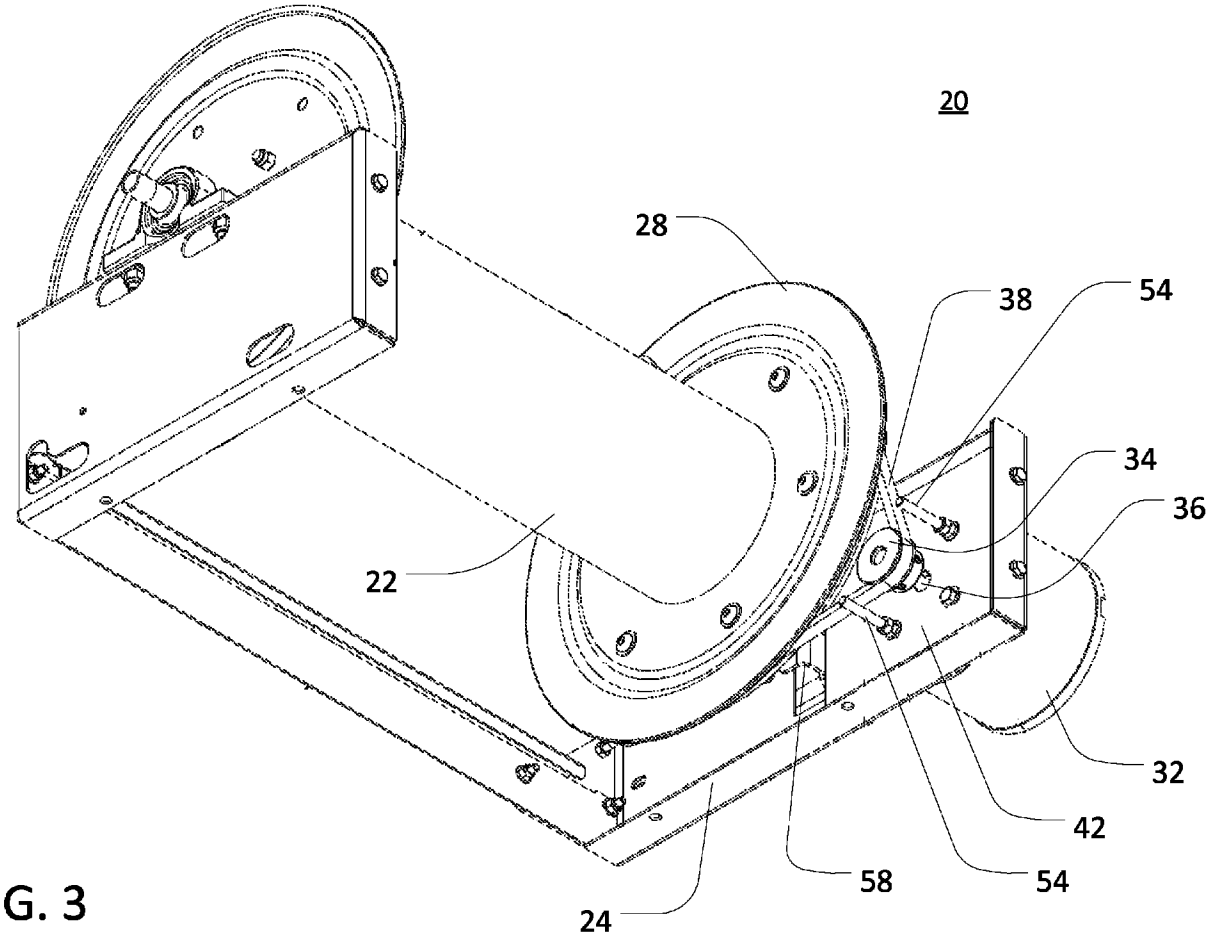

Referring also to FIGS. 2 and 3, motor 32 (e.g., an electrical motor) is configured to provide rotational power to powered wheel 34. Like input wheel 28, wheel 34 is depicted in the various figures as a sheave or pulley for a v-belt such as belt 38. (It will be understood, however that various other configurations are possible, including flat or curved pulleys, notched wheels, toothed sprockets or gears, and on, as paired with appropriately complimentary belts, ropes, chains, and so on.) When belt 38 is appropriately tensioned between wheels 28 and 34, and motor 32 is operating appropriately, rotational power is transferred from motor 32 to input wheel 28 (and reel core 22) via powered wheel 34 and belt 38.

It will be understood that various power connections, conduits, control circuits and the like (not shown in the various figures) may be provided to supply power (e.g., electrical power), control signals, or other inputs or control to motor 32 or various other components of assembly 20. In certain embodiments, motor 32 may always provide rotational power to powered wheel 34, so long as power is generally supplied to reel assembly 20. As such, in certain embodiments, powered wheel 34 may continuously rotate so long as power is generally supplied to reel assembly 20. In certain embodiments, however, motor 32 may sometimes not provide rotational power to powered wheel 34, even though power is generally available to reel assembly 20. As such, in certain embodiments, powered wheel 34 may spin only some of the time that power is supplied to reel assembly 20.

Figure 4:
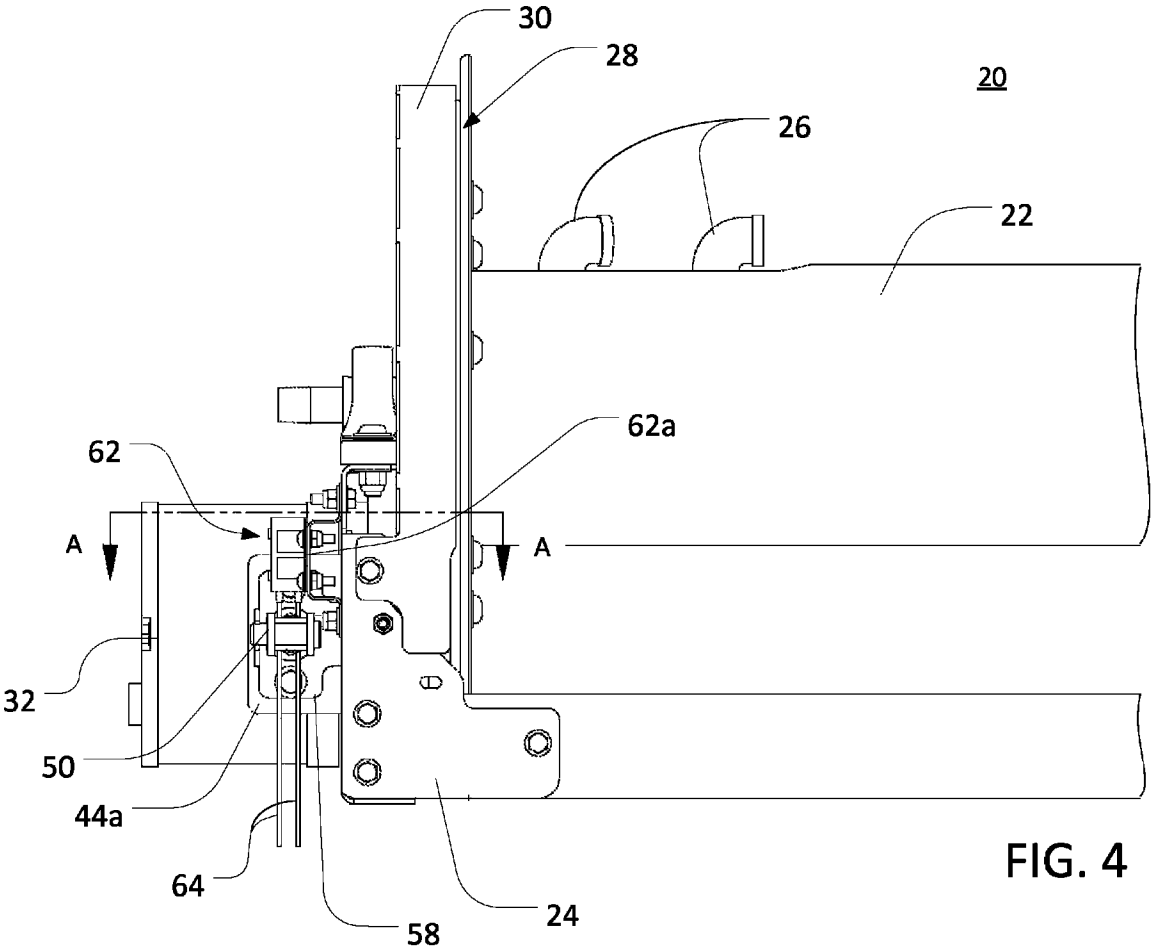
FIG. 4 is a partial front view of the reel assembly and control system of FIGS. 1-3.
Figure 5:
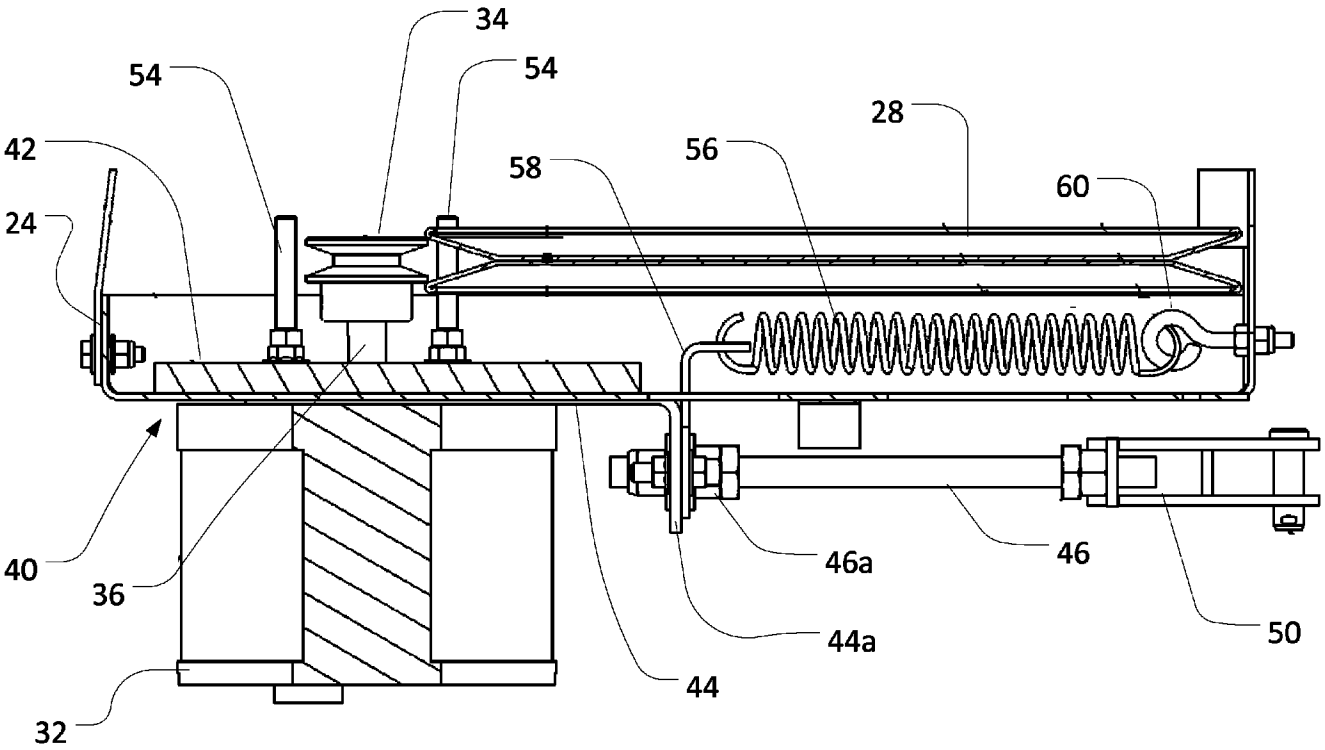
FIG. 5 is a sectional view of the control system of FIGS. 1-3, taken along plane A-A of FIG. 4.
Figure 6:
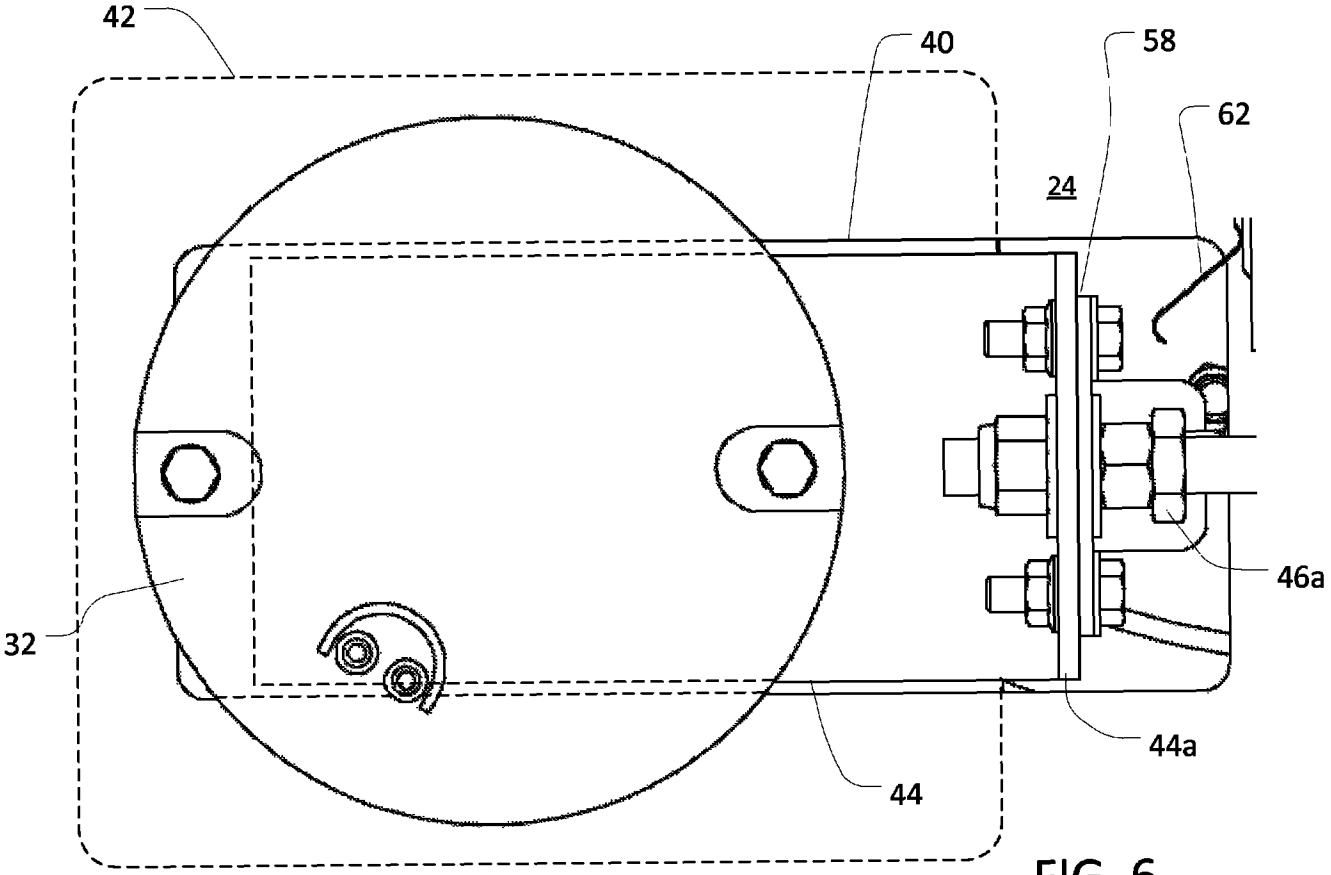
FIG. 6 is a partial side view of the reel assembly and control system of FIGS. 1-3.

Referring also to FIGS. 4-6, in order to facilitate control of the rotation of input wheel 28 (and, thereby, of reel core 22), rectangular opening 40 is provided in a portion of reel frame 24. Motor 32 is mounted along opening 40 on one side of frame 24, and is wider (from top to bottom, in the various figures) than opening 40 such that, when mounted as shown, motor 32 may not pass through opening 40. Slide plate 42 is also wider (from top to bottom, in the various figures) than opening 40, and is also mounted along opening 40, but is generally located across opening 40 from motor 32. As such, when mounted as shown slide plate 42 is also prevented from passing through opening 40. In certain embodiments, slide plate 42 is manufactured from materials (or with various coatings) that have a relatively low coefficient of friction (e.g., one or more of various polymer materials, such as ultra-high-molecular-weight ("UHMW") polyethylene), so that slide plate 42 may easily slide along the interior surface of frame 24. (It will be understood that the functionality of slide plate 42 (and mounting plate 44, below) may be provided by features of various configurations, including slide (or mounting) members having various non-plate configurations (not shown).)

In the embodiment depicted, mounting plate 44, with mounting bracket **44*a* is oriented between slide plate 42 and motor 32, and motor 32 is mounted to slide plate 42 (e.g., via a connection extending through mounting plate 44), with spindle 36 extending from motor 32 through slide plate 42 and mounting plate 44 to provide rotational power to powered wheel 34. In certain embodiments, motor 32 is mounted via bolts that extend past slide plate 42 to form guide pins 54**, which are discussed in greater detail below.

In certain embodiments, mounting plate 44 is configured to be slightly thicker than frame 24 at opening 40. Accordingly, when motor 32, mounting plate 44, and slide plate 42 are mounted together and slide plate 42 is seated closely against frame 24, motor 32 clears frame 24 by a small amount. In this way, motor 32, slide plate 42, and powered wheel 34 are collectively secured to frame 24 (i.e., because motor 32 and mounting plate 42, when mounted together, form an assembly that cannot pass through opening 40 in either direction), and are also permitted to slide along frame 24 to a certain degree, in order to vary location of wheel 34, with respect to wheel 28. In certain embodiments, various guides (not shown) may be provided to further secure the combined assembly of plates 42 and 44 and motor 32 to frame 24, or facilitate the sliding of the combined assembly with respect to frame 24. It will be understood that, in certain embodiments, mounting plate 44 and slide plate 42 may be integrally formed, rather than being formed as separate pieces.

Motor 32, mounting plate 42 and powered wheel 34 may be engaged in various ways to slide these features along opening 40 (i.e., in order to change the relative position of powered wheel 34 with respect to input wheel 28 of reel core 22). As depicted, for example, control rod 46 is connected at one end, via mounting bracket 44*a*, to mounting plate 44 (and slide plate 42), and is connected at the other end, via control link 50, to control lever 48 (see FIGS. 2, 7B and 8B). In certain embodiments, control rod 46 may be threaded in order to allow customizable extension away from bracket 44*a*. Control lever 48, in turn, is fixed with respect to frame 24 via lever bracket 52 (see FIG. 2). In this way, an operator (or other source of movement) may slide motor 32, mounting plate 42 and powered wheel 34 to various positions along opening 40 by pivoting lever 48 around its connection with bracket 52. Various types of connections of these (or similar) components may be possible. As depicted in the various figures, for example, a self-locking nut, a nut, and a jam-nut may be utilized at connection 46*a* in order to accommodate various degrees of non-axial movement of rod 46, as lever 48 is utilized.

Although control lever 48 is depicted as being connected to control link 50 with a clevis and cotter pin assembly, it will be understood that various other configurations may be possible (for this and other connections described herein). Likewise, it will be understood that various features, such as control rod 46 and control link 50 or control link 46 and lever 48, may sometimes be formed as unitary bodies rather than as separate elements, and may be configured differently than the embodiment depicted in the figures. For example, the shape, size, or orientation of lever 48 may be varied depending on the particular platform or application for which a particular reel (or other) assembly is intended.

In certain embodiments, various additional (or alternative) features may be provided to control or limit the above-noted movement of motor 32, slide plate 42 and powered wheel 34. For example, from the perspective of FIG. 5, tension on belt 38 (not shown in FIG. 5), with the belt is seated in both of wheels 28 and 34, enforces a limit to the left-ward movement of slide plate 42. Similarly, contact between mounting bracket 44*a* (or spring bracket 58) and frame 24 (e.g., at the right edge of opening 40) enforces a limit to right-ward movement of slide plate 42. In certain embodiments, however, slide plate 42 (or mounting plate 44 and so on) may additionally (or alternatively) be configured to come into contact with various features (e.g., various features of frame 24) to prevent further movement of plate 42 in a particular direction. In this way, for example, through appropriate configuration slide plate 42, mounting plate 44, mounting bracket 44*a*, opening 40, or various other features of assembly 20, an appropriate range of motion may be established for slide plate 42, motor 32, or powered wheel 34.

Figure 7A:
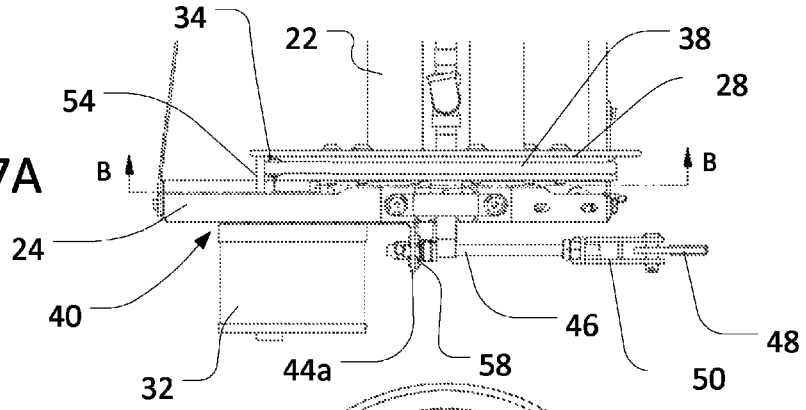
FIG. 7A is a partial top view of the reel assembly and control system of FIGS. 1-3, with the control system in a disengaged state.
Figure 7B:
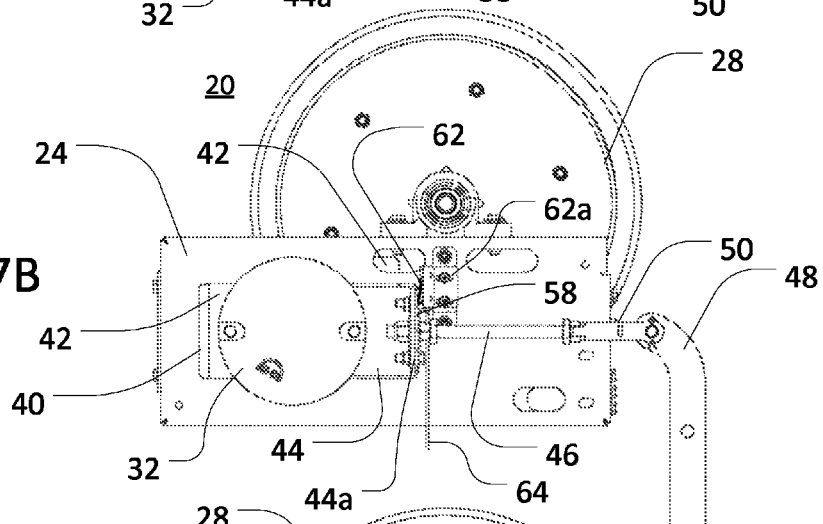
FIG. 7B is a side view of the reel assembly and control system of FIGS. 1-3, with the control system in the disengaged state of FIG. 7A.
Figure 7C:
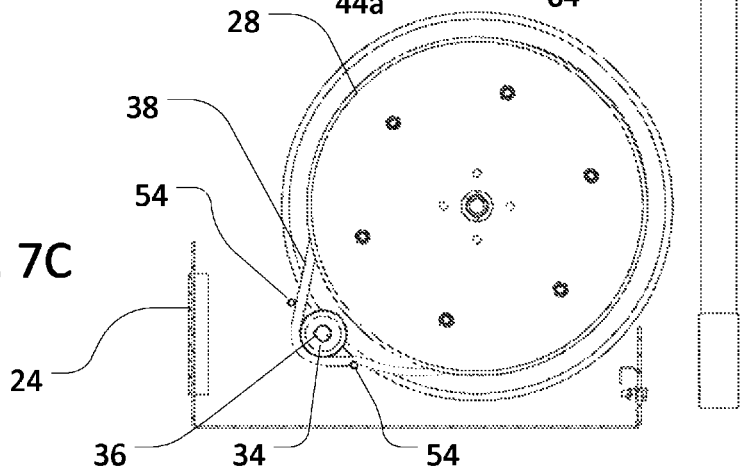
FIG. 7C is a sectional view of the reel assembly and control system of FIGS. 1-3, taken along plane B-B of FIG. 7A, with the control system in the disengaged state of FIG. 7A.

Referring also to FIGS. 7A-C and 8A-C, an example operation of the disclosed control system is depicted, in order to control rotation of reel core 22. In FIGS. 7A-C, for example, the control system is depicted in a disengaged state, such that even if motor 32 is providing rotational power to powered wheel 34, rotational power is not transferred by belt 38 to input wheel 28 (and reel core 22). As depicted in FIGS. 7A and 7B, control lever 48 has been pivoted such that mounting bracket 44*a* is located at the right side of opening 40. Correspondingly, slide plate 42 and motor 32 are located at the right-side limit of their range of lateral motion. As depicted in FIG. 7C, this orientation of plate 42 and motor 32 corresponds to powered wheel 34 having also moved to the right (i.e., because wheel 34 is directly connected to motor 32 by spindle 36), with wheel 34 thereby releasing tension from belt 38 and preventing rotational power from being transferred from wheel 34, via belt 38, to wheel 28. Accordingly, in the orientation depicted in FIGS. 7A-C, reel core 22 may be relatively free-spinning, allowing, for example, for the manual unwinding of hoses (not shown) carried by core 22. In such a configuration, guide pins 54 (e.g., mounted to mounting plate 42, as depicted in FIGS. 3 and 5) partially restrict the movement of the now-slackened belt 38, in order to keep the belt seated on wheel 34 and generally aligned with wheel 28.

Figure 8A:
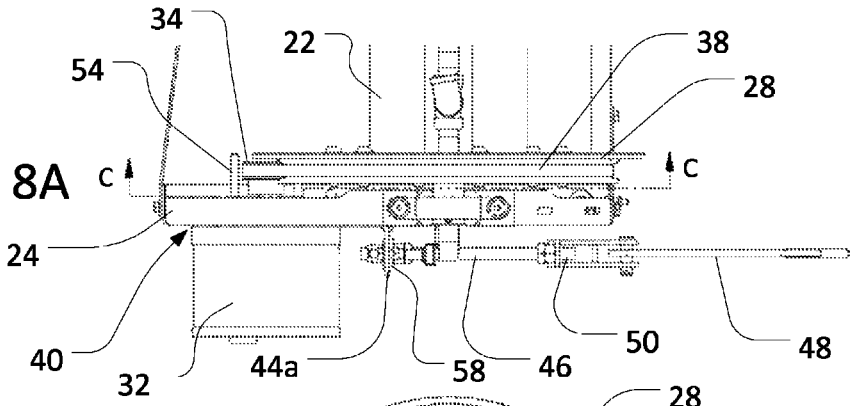
FIG. 8A is a partial top view of the reel assembly and control system of FIGS. 1-3, with the control system in an engaged state.
Figure 8B:
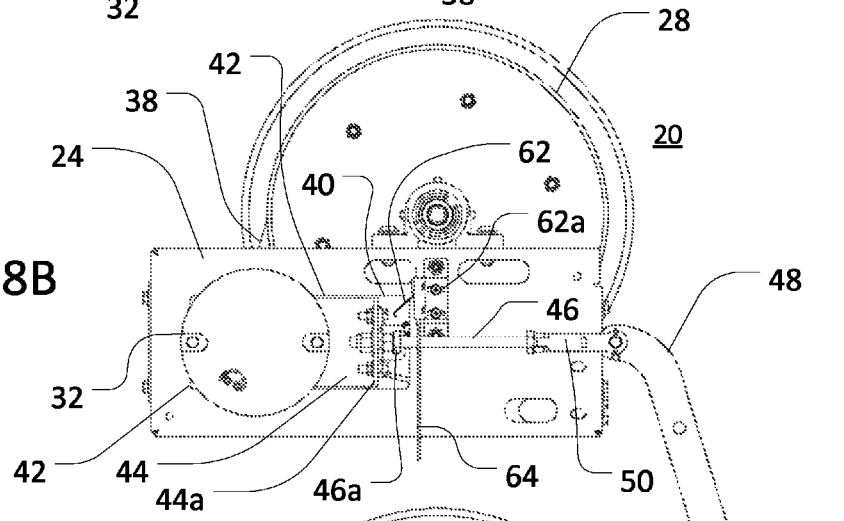
FIG. 8B is a side view of the reel assembly and control system of FIGS. 1-3, with the control system in the engaged state of FIG. 8A.
Figure 8C:
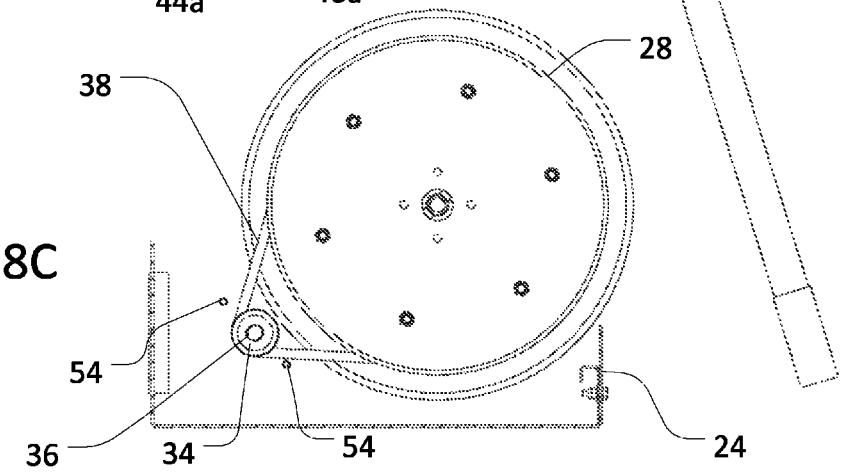
FIG. 8C is a sectional view of the reel assembly and control system of FIGS. 1-3, taken along plane C-C of FIG. 8A, with the control system in the engaged state of FIG. 8A.

In FIGS. 8A-C, in contrast, the control system is depicted in an engaged state, such that if motor 32 is providing rotational power to powered wheel 34, rotational power is transferred by belt 38 to input wheel 28 (and reel core 22). For example, as depicted in FIGS. 8A and 8B, control lever 48 has been pivoted such that control rod 46 has driven mounting bracket 44*a* to the left-side limit of its range of lateral motion. Accordingly, slide plate 42 and motor 32 are also at the left-side limit of their range of motion (e.g., as limited by the tension of belt 38 between wheels 28 and 34). As depicted in FIG. 8C, this orientation of plate 42 and motor 32 corresponds to powered wheel 34 having also moved to the left, thereby firmly seating belt 38 on wheel 28 and providing belt 38 with operational tension. Accordingly, when wheel 34 is rotated by motor 32, belt 38 is driven by wheel 34 such that belt 38, in turn, drives rotation of wheel 28 (and reel core 22). In contrast to when powered wheel 36 is in a disengaged position (as in FIGS. 8A-C), it can be seen in FIGS. 8A-C that with powered wheel 36 placing belt 38 under operational tension guide pins 54 no longer restrict movement of belt 38.

In this way, for example, with respect to a hose reel assembly 20, various hoses (not shown) may be manually unwound from reel core 22 for use, then re-wound for storage and transport with the assistance of motor 32. For example, a user (or biasing element, as discussed in detail below) may move lever 48 to the position depicted in FIG. 7B, and thereby release tension from belt 38 to prevent the flow of power from motor 32 to reel core 22. The user may then manually unwind the hoses by various amounts in order to complete a desired operation. When the user has finished with the hoses, she may then move lever 48 to the position depicted in FIG. 8B, thereby applying appropriate operational tension to belt 38 (as seated on wheels 28 and 34) in order to allow motor 32 to power the rewinding of the hose. (It will be understood, that a reversed configuration may also be possible, in which a motor rotating in a reversed direction assists in an unwinding operation.)

In certain embodiments, various other features may be included, such as various devices to automatically control operation of motor 22. For example, as depicted in the various figures, switch 62 is located along the path of travel of control rod 46, with leads 64 providing control signals to an electrical relay (not shown) to control current flow to motor 32. With the control system oriented as depicted in FIGS. 7A-C, switch 62 may be depressed by one of brackets 44*a* or 58 (or another feature), causing switch 62 to stop operation of motor 42 (e.g., by causing a contact in a relay (not shown) to open). As control rod 46 moves to the left, however, as depicted in FIGS. 8A-C, brackets 44*a* and 58 (or various other features) move away from switch 62, thereby causing switch 62 to start operation of motor 42 (e.g., by causing a contact in a relay (not shown) to close). In certain embodiments, switch 62 may be adjustable to control the precise point of activation (or deactivation) of motor 32. For example, various mounting slots included in sensor mount 62*a*, in the embodiment depicted, allow for a range of positions of switch 62, with respect to frame 24.

Continuing, in certain embodiments, one or more biasing elements may be provided in order to bias the disclosed control system toward a particular orientation. For example, referring again to FIG. 5, spring 56 extends between spring bracket 58 and spring hook 60 in order to bias mounting plate 42 and, correspondingly, powered wheel 34, to the right (i.e., via the connection between spring bracket 58 and mounting bracket 44). In this way, for example, in a default state, the control system releases tension from belt 38 and cuts off power to motor 32, thereby allowing reel core 22 to rotate freely. Accordingly, only when a user (or other control source) is actively engaging the system (e.g., by actively holding lever 48 in the activating orientation (see FIG. 8B) will rotation of reel core 22 be driven by motor 32 (via wheel 34 and belt 38). Other configurations may also be possible, however, including configurations employing additional (or alternative) biasing elements, mounting configurations, or bias directions.

In certain embodiments, the disclosed control system may further allow for relatively precise control of the engagement of a drive system for a reel core (or other rotating machinery). As also noted above, certain embodiments of the disclosed system allow a powered rotating member (e.g., wheel 34) to be moved between positions at which a power-transfer device (e.g., belt 38) is fully engaged (e.g., is at full operational tension, as depicted in FIG. 8C) or is fully disengaged (e.g., is sufficiently slack that the power-transfer device does not transfer rotational power to wheel 28, as depicted in FIG. 7C). In certain embodiments, the disclosed system may additionally (or alternatively) allow a user (or other source of movement) to move the powered member to various intermediate positions, which may allow for partial transfer of power from the powered member. For example, in the embodiment depicted in the various figures, a user may move wheel 34, using lever 48, from the position depicted in FIG. 7C (at which no power is transferred to wheel 28 by belt 38), towards, but not entirely to, the position depicted in FIG. 8C (at which full power is transferred to wheel 28 by belt 38). In this way, the user may place wheel 34 at an intermediate position at which belt 38 is somewhat, but not completely, tensioned and, as such, allows the transfer of some, but not full, power from motor 32 to wheel 28. This may be useful, for example, in order to control acceleration of wheel 28, or to more finely control the rate at which wheel 28 rotates (and, for example, the rate at which an associated hose is re-wound).

Various other configurations are also possible. For example, various mechanisms, including various automated mechanisms such as solenoids, servo motors, or other actuators, may be utilized in addition (or as an alternative) to control lever 48 or control rod 46, in order to move wheel 34 between its engaged and disengaged positions. For example, a user may engage a control switch (not shown) in order to cause a solenoid actuator to move wheel 34 along frame 24, or a sensor (not shown) may detect a desired operation (e.g., a desired unwinding operation) and may cause an actuator to move wheel 34 accordingly.

Continuing, various embodiments may provide for control of power transfer between a powered member (e.g., wheel 34) and a driven member (e.g., wheel 28) without the use of an intervening power-transfer device (e.g., belt 38). For example, with wheel 34 configured to directly engage wheel 28 (e.g., with both wheels configured with durable rubber or polymer rims for direct transfer of rotational power), a user may control rotation of wheel 28 (or a similar component) in a manner similar to that described above (i.e., through re-orientation of wheel 34), but with wheel 34 directly contacting wheel 28 (or a similar component) when in an engaged state in order to power rotation of wheel 28. Additionally (or alternatively) other intervening members (e.g., other rubber- or polymer-rimmed wheels) may be oriented between wheels 28 and 34 (or similar components), such that wheel 28 may be engaged in order to power wheel 34 by bringing wheel 28 into direct (or other) engagement with the intervening member.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, members, and/or components, but do not preclude the presence or addition of one or more other features, integers, steps, operations, members, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A control system for powered reels, the control system comprising:

a power source providing rotational power to a powered wheel, at least one of the power source and the powered wheel being slidably mounted to a reel frame;

a reel core rotatably mounted to the reel frame, the reel core including an input wheel;

a power-transfer belt seated on at least one of the powered wheel and the input wheel, the power-transfer belt extending between the powered wheel and the input wheel;

a control member linked to the powered wheel, the control member being movable between a first orientation and a second orientation to slide the powered wheel along the reel frame between an engaged position and a disengaged position; and at least one guide member located opposite the power-transfer belt from the powered wheel, the at least one guide member restricting movement of the power-transfer belt when the powered wheel is in the disengaged position;

wherein, with the powered wheel in the engaged position, the power-transfer belt is engaged and rotational power is transferred from the power source to the input wheel via the powered wheel and the power-transfer belt; and wherein, with the powered wheel in the disengaged position, the power-transfer belt is disengaged and rotational power is not transferred from the power source to the input wheel via the powered wheel and the power-transfer belt.

2. The control system of claim 1, further comprising:

an opening extending between first and second sides of the reel frame, the opening being narrower than the power source in a first dimension, the power source being located, at least in part, along the opening on the first side of the reel frame; and a slide member that is wider than the opening in a second dimension, the slide member being located, at least in part, along the opening on the second side of the reel frame and between the power source and the powered wheel, the power source being fixed to the slide member;

wherein moving the control member between the first and the second orientations causes at least one of the slide member and the power source to slide along the opening to move the powered wheel between the engaged and the disengaged positions.

3. The control system of claim 1, wherein, with the powered wheel in the engaged position, the powered wheel places the power-transfer belt under a first tension, the power-transfer belt thereby transferring rotational power from the powered wheel to the input wheel; and wherein, with the powered wheel in the disengaged position, the powered wheel releases the power-transfer belt from the first tension, the power-transfer belt thereby not transferring rotational power from the power source to the input wheel.

4. The control system of claim 1, wherein the reel core is part of a hose reel.

5. The control system of claim 1, further comprising:

a lever linked to the control member and fixed at a pivot point, with respect to the reel core;

wherein pivoting the lever causes the control member to move between the first and the second orientations.

6. The control system of claim 1, wherein the powered wheel is biased toward the disengaged position.

7. The control system of claim 1, further comprising:

a switch device in communication with the power source;

wherein, moving the control member to the second orientation causes the switch device to cause the power source to cease providing rotational power to the first rotating member; and wherein, moving the control member from the second orientation toward the first orientation causes the switch device to cause the power source to begin providing rotational power to the powered wheel.

8. A control system for controlling powered rotation, the control system comprising:

a power source providing rotational power to a first rotating member;

a second rotating member including an input portion;

a flexible power-transfer device extending between the first rotating member and the input portion of the second rotating member;

a control member linked to the first rotating member, the control member being movable between a first orientation and a second orientation; and at least one guide member located opposite the power-transfer device from the first rotating member, the at least one guide member restricting movement of the power-transfer device when the first rotating member is in the disengaged position;

wherein moving the control member to the first orientation causes the first rotating member to move to an engaged position, whereby the power-transfer device is engaged and rotational power is transferred from the power source to the input portion of the second rotating member via the first rotating member and the power-transfer device; and wherein moving the control member to the second orientation causes the first rotating member to move to a disengaged position, whereby the power-transfer device is disengaged and rotational power is not transferred from the power source to the input portion of the second rotating member via the first rotating member and the power-transfer device.

9. The control system of claim 8, wherein at least one of the power source and the first rotating member are slidably mounted to a frame, whereby sliding the at least one of the power source and the first rotating member along the frame causes the first rotating member to move between the engaged position and the disengaged position.

10. The control system of claim 9, wherein the frame includes an opening between first and second sides of the frame;

wherein the power source is located, at least in part, on the first side of the frame and is wider than the opening in a first dimension; and wherein the first rotating member and the input portion of the second rotating member are located, at least in part, on the second side of the frame.

11. The control system of claim 10, further comprising:

a slide member that is wider than the opening in a second dimension, the slide member being located, at least in part, on the second side of the frame and between the power source and the first rotating member, the power source being fixed to the slide member;

wherein moving the control member between the first and the second orientations causes at least one of the slide member and the power source to slide along the opening to move the first rotating member between the engaged and the disengaged positions.

12. The control system of claim 8, wherein the second-rotating member includes a reel core of a hose reel.

13. The control system of claim 8, wherein at least one of first rotating member and the input portion of the second rotating member includes a wheel.

14. The control system of claim 8, wherein the power-transfer device includes a belt.

15. The control system of claim 14, wherein, with the first rotating member in the engaged position, the first rotating member places the belt under a first tension, the belt thereby transferring rotational power from the first rotating member to the input portion of the second rotating member; and wherein, with the first rotating member in the disengaged position, the first rotating member releases the belt from the first tension, the belt thereby not transferring rotational power from the first rotating member to the input portion of the second rotating member.

16. The control system of claim 8, further comprising:

a lever linked to the control member and fixed at a pivot point, with respect to the reel core;

wherein pivoting the lever causes the control member to move between the first and the second orientations.

17. The control system of claim 8, wherein the first rotating member is biased toward the disengaged position.

18. The control system of claim 8, further comprising:

a switch device in communication with the power source;

wherein, moving the control member to the second orientation causes the switch device to cause the power source to cease providing rotational power to the first rotating member; and wherein, moving the control member from the second orientation toward the first orientation causes the switch device to cause the power source to begin providing rotational power to the first rotating member.

* * * * *